US010312644B2

(12) United States Patent
Tsau

(10) Patent No.: US 10,312,644 B2
(45) Date of Patent: Jun. 4, 2019

(54) CONNECTOR

(71) Applicant: EZCONN CORPORATION, Taipei (TW)

(72) Inventor: Chang-Jie Tsau, Taipei (TW)

(73) Assignee: EZCONN CORPORATION, Taipei (TW)

( * ) Notice: Subject to any disclaimer, the term of this patent is extended or adjusted under 35 U.S.C. 154(b) by 2 days.

(21) Appl. No.: 15/473,655

(22) Filed: Mar. 30, 2017

(65) Prior Publication Data

US 2017/0317453 A1 Nov. 2, 2017

(30) Foreign Application Priority Data

Apr. 28, 2016 (TW) ..... 105206096 U

(51) Int. Cl.

| | |
|---|---|
| ***H01R 13/60*** | (2006.01) |
| ***H01R 24/38*** | (2011.01) |
| ***H01R 13/622*** | (2006.01) |
| ***H01R 13/02*** | (2006.01) |
| ***H01R 13/73*** | (2006.01) |
| *H01R 103/00* | (2006.01) |

(52) U.S. Cl.

CPC ..... *H01R 24/38* (2013.01); *H01R 13/02* (2013.01); *H01R 13/622* (2013.01); *H01R 13/73* (2013.01); *H01R 2103/00* (2013.01)

(58) Field of Classification Search

CPC ..... H01R 13/518; H01R 13/745; H01R 23/7042; H01R 23/025; H01R 13/5202

USPC ..... 439/540.1, 534, 550, 563, 536, 527

See application file for complete search history.

(56) References Cited

U.S. PATENT DOCUMENTS 8,109,787 B1 * 2/2012 Kun-Tse ..... H01R 35/04 439/578

* cited by examiner

*Primary Examiner* — Phuong Chi T Nguyen

(74) *Attorney, Agent, or Firm* — Min-Lee Teng; Litron Patent & Trademark Office

(57) ABSTRACT

A connector IS configured to be screwed with another connector for a coaxial cable. The connector includes a sleeve having an outer thread configured to be screwed with an inner thread of a nut of the another connector, wherein a first opening in the sleeve has an axial center at a first axis and configured to receive a front portion of a metal core of the coaxial cable; and an insulating element having an annular portion received in a second opening in the sleeve, wherein the annular portion has a cylindrical periphery with respect with a second axis, wherein the first and second axes are parallel to and offset from each other.

20 Claims, 6 Drawing Sheets

CONNECTOR

RELATED APPLICATION

This patent application claims priority of Taiwan Patent Application No. 105206096, filed on Apr. 28, 2016, the entirety of which is incorporated herein by reference.

BACKGROUND OF THE DISCLOSURE

Field of the Disclosure

The present invention relates generally to a connector for a shielding device, and more particularly to a connector set with an axial offset.

Brief Description of the Related Art

A screw-on F-type connector may be employed to connect a coaxial cable to a cable-TV decoder, a digital hard-disk recorder for a video cassette recorder (VCR) or digital versatile/video disc (DVD), a satellite receiver, a video games, a TV signal distribution splitter or a switch.

A connector for an electronic device is generally provided with two opposite ends, a first one of which may join another connector for a coaxial cable, such as F-type coaxial cable connector and a second one of which may join the electronic device, such as shielding device. A through hole at the second end of the connector for the electronic device may allow a signal transmitting metal line to pass through the through hole to connect with circuitry in the electronic device. The through hole has an axial center coaxial with an axial center of a main body of the connector for the electronic device. When the connector for the coaxial cable is screwed to the connector for the electronic device, the connector for the electronic device may be caused to be coaxially rotated. This situation creates some critical problems.

SUMMARY OF THE DISCLOSURE

The disclosure provides a connector for an electronic device. Two openings at two opposite ends of a sleeve of the connecter for the electronic device have an axial offset such that the bonding of the connector for the electronic device to a frame of the electronic device can be strengthened. The torque created when a connector for a coaxial cable has a nut being screwed onto the connector for the electronic device can be further resisted by the frame.

The connector for the electronic device may include a sleeve provided with an outer thread on an outer periphery of the sleeve, wherein the outer thread is configured to be screwed with a nut of a connector for a coaxial cable. The sleeve has a first end and a second end opposite to the first end, wherein a first opening is at the first end and a second opening is at the second end, wherein the first and second openings have an axial offset.

These, as well as other components, steps, features, benefits, and advantages of the present disclosure, will now become clear from a review of the following detailed description of illustrative embodiments, the accompanying drawings, and the claims.

BRIEF DESCRIPTION OF THE DRAWINGS

The drawings disclose illustrative embodiments of the present disclosure. They do not set forth all embodiments.

Other embodiments may be used in addition or instead. Details that may be apparent or unnecessary may be omitted to save space or for more effective illustration. Conversely, some embodiments may be practiced without all of the details that are disclosed. When the same reference number or reference indicator appears in different drawings, it may refer to the same or like components or steps.

Figure 1:
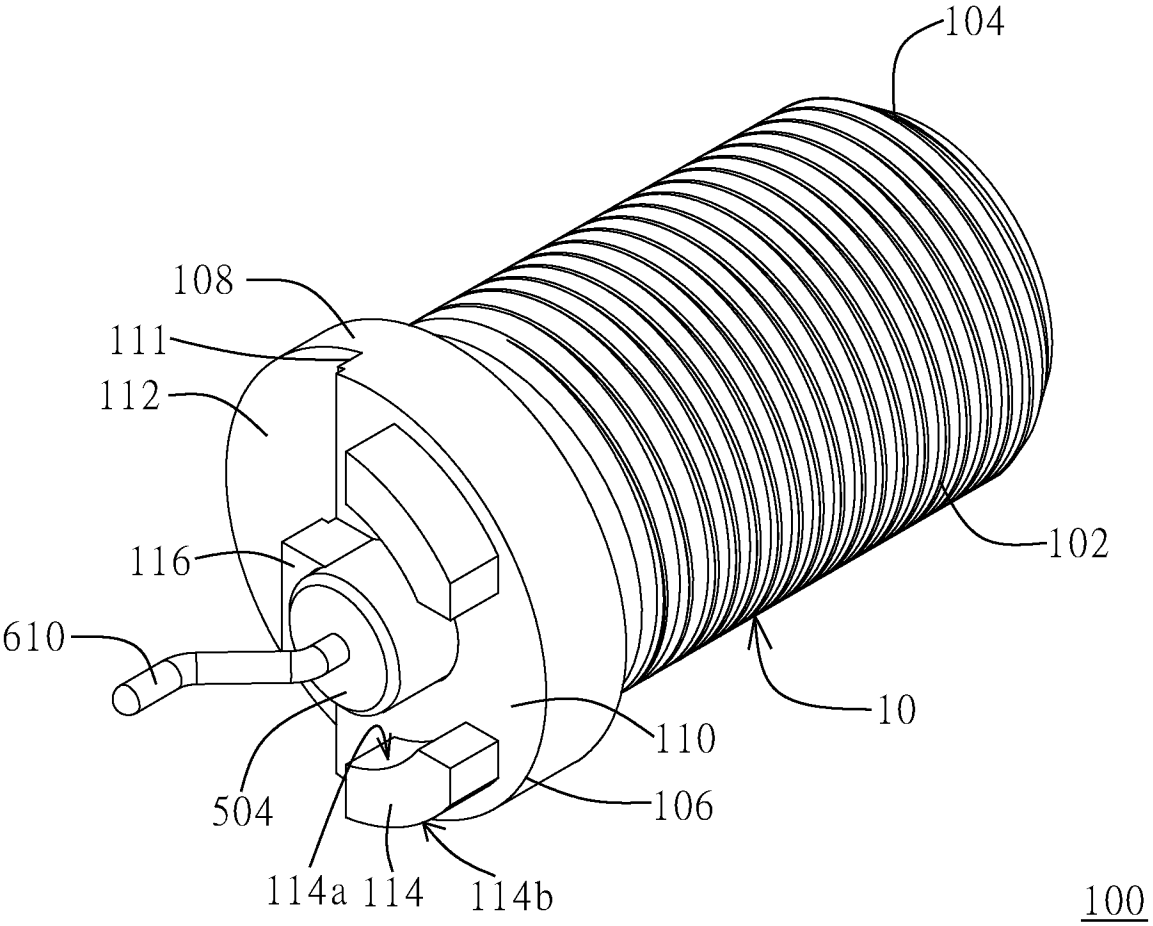
Figure 2:
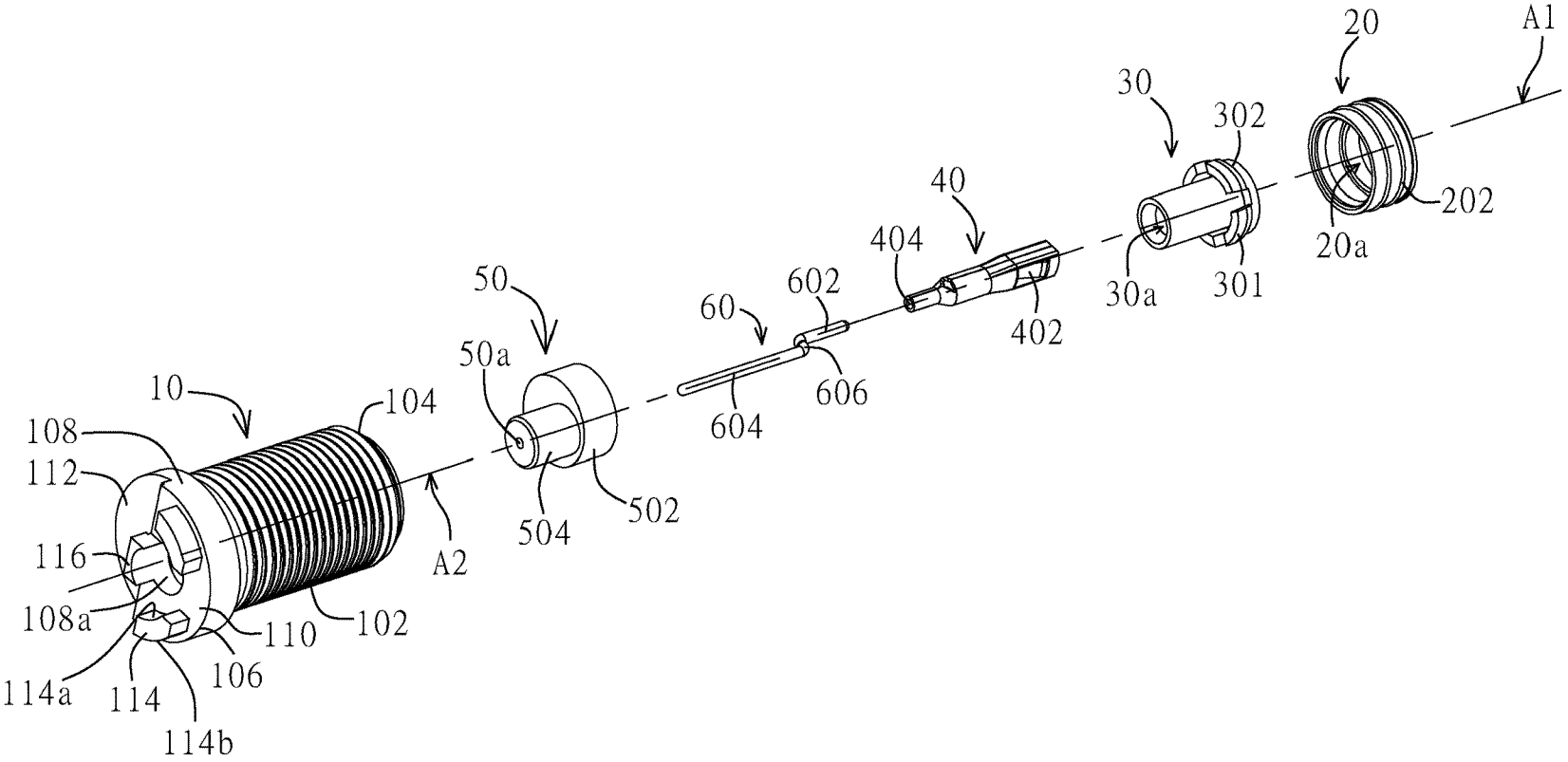
Figure 3:
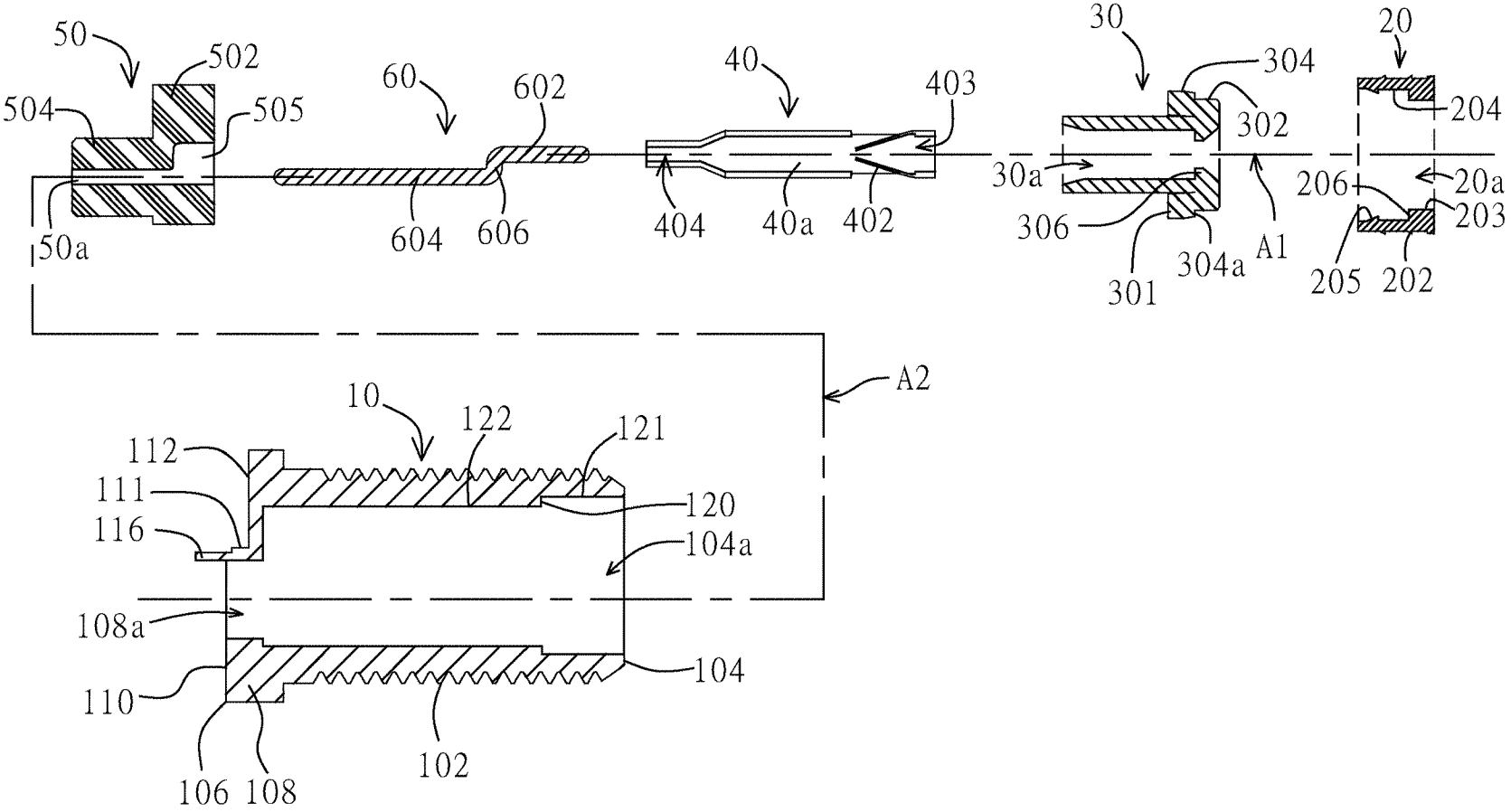
Figure 4:
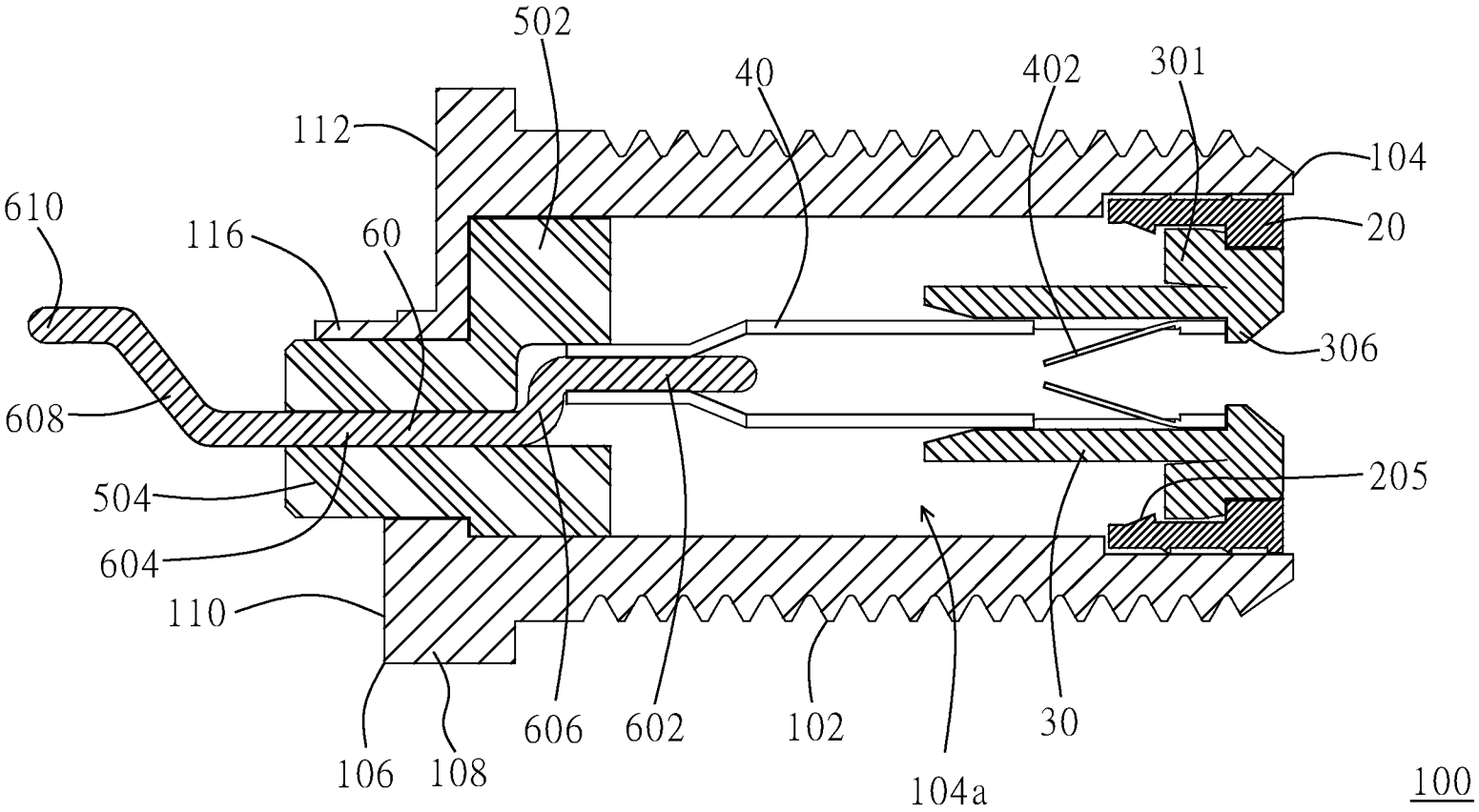
Figure 5B:
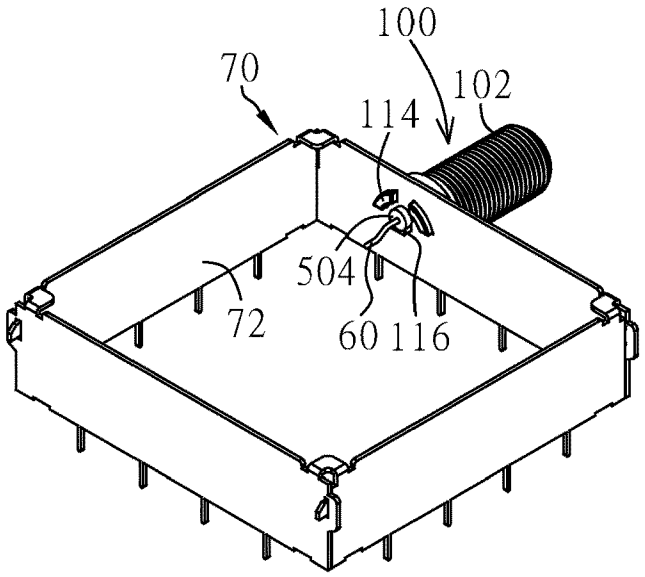
Figure 5A:
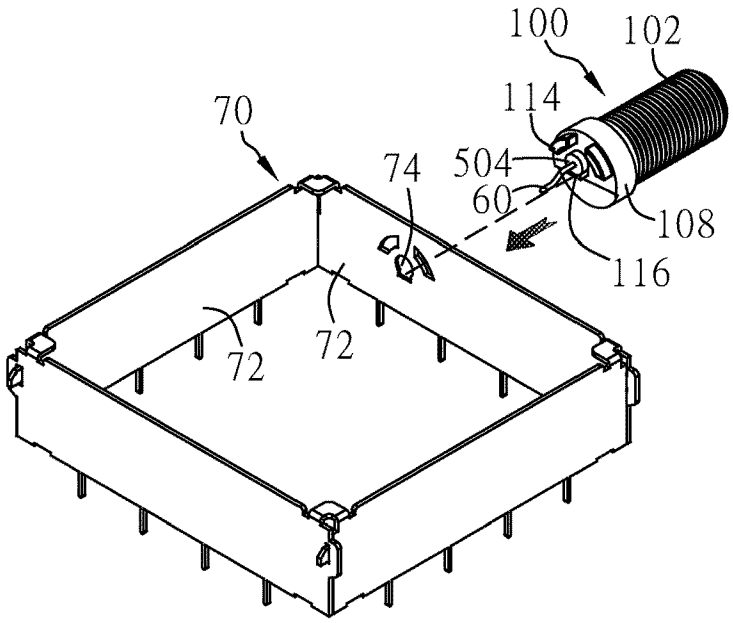
Figure 5C:
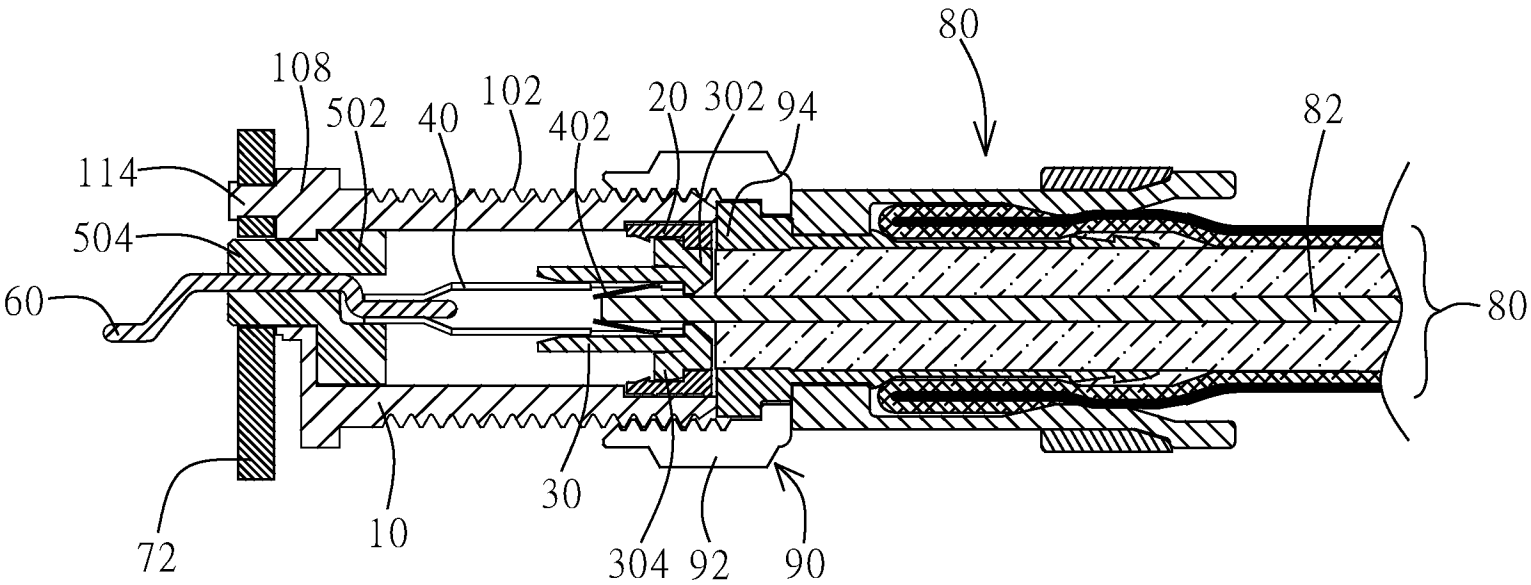

Aspects of the disclosure may be more fully understood from the following description when read together with the accompanying drawings, which are to be regarded as illustrative in nature, and not as limiting. The drawings are not necessarily to scale, emphasis instead being placed on the principles of the disclosure. In the drawings:

FIG. 1 is a schematically perspective view showing a connector for an electronic device in accordance with an embodiment of the present invention;

FIG. 2 is a schematically perspective exploded view showing the connector for the electronic device in accordance with the embodiment of the present invention;

FIG. 3 is a schematically cross-sectional exploded view showing the connector for the electronic device in accordance with the embodiment of the present invention;

FIG. 4 is a schematically cross-sectional view showing the connector for the electronic device in accordance with the embodiment of the present invention;

FIGS. 5A and 5B are a schematically perspective views showing the connector for the electronic device is mounted onto a frame of the electronic device in accordance with the embodiment of the present invention; and FIG. 5C is a schematically cross-sectional view showing the connector for the electronic device is mounted onto the frame of the electronic device in accordance with the embodiment of the present invention.

While certain embodiments are depicted in the drawings, one skilled in the art will appreciate that the embodiments depicted are illustrative and that variations of those shown, as well as other embodiments described herein, may be envisioned and practiced within the scope of the present disclosure.

DETAILED DESCRIPTION OF THE INVENTION

Illustrative embodiments are now described. Other embodiments may be used in addition or instead. Details that may be apparent or unnecessary may be omitted to save space or for a more effective presentation. Conversely, some embodiments may be practiced without all of the details that are disclosed.

Referring to FIGS. 1-4, the disclosure provides a connector 100 for an electronic device configured to be mounted to a frame of a shielding shell of the electronic device, wherein the shielding shell is configured for shielding interference of electromagnetic waves. The connector for the electronic device is designed with axial-offset openings, that is, two openings at two opposite ends of the connector for the electronic device have an axial offset such that the bonding of the connector for the electronic device to the frame of the electronic device can be strengthened.

Referring to FIGS. 1-4, the connector 100 for the electronic device includes a sleeve 10, a tube 20, a first fixing element 30, a second fixing element 40, a third fixing element 50 and a metal trace 60. The tube 20, first fixing element 30, second fixing element 40, third fixing element 50 and metal trace 60 may be first assembled into an assembly, and then the assembly is mounted into the sleeve 10.

Referring to FIGS. 1-4, the sleeve 10 made of a conductive material, such as metal, copper, aluminum, silver, nickel, zinc, iron or an alloy of the above-mentioned materials, is provided with an outer thread 102 at an outer periphery of the sleeve 10 and has an axial center at a first axis A1 in the sleeve 10. The sleeve 10 has a first end 104, i.e., rear end, having a connector 90 for a coaxial cable as seen in FIG. 5C to be screwed thereto and a second end 106, i.e., front end, mounted to the frame 70 of the shielding shell of the electronic device as seen in FIG. 5B. An opening 104*a* in the sleeve 10 is formed at the first end 104 of the sleeve 10 and an opening 108*a* in the sleeve 10 is formed at the second end 106 of the sleeve 10, wherein the opening 104*a* communicate with the opening 108*a*. The openings 104*a* and 108*a* have an axial offset, that is, the opening 104*a* in the sleeve 10 has an axial center at the first axis A1 in the sleeve 10 and the opening 108*a* in the sleeve 10 has an axial center at a second axis A2 in the sleeve 10, wherein the first and second axes A1 and A2 are parallel and offset from each other. The opening 104*a* has a greater diameter than the opening 108*a*. The sleeve 10 has an outer flange 108 protruding from its outer periphery at the second end 106 thereof. The sleeve 10 has a step formed with two radially-extending surfaces 110 and 112 parallel to and non-coplanar with each other and vertical to the first and second axes A1 and A2 and an axially-extending surface 111 vertical to the radially-extending surfaces 110 and 112 and parallel to the first and second axes A1 and A2. The axially-extending surface 111 may have two opposite sides joining the radially-extending surfaces 110 and 112 respectively. The sleeve 10 includes multiple arcuate protrusions 114 axially protruding in the first axis A1 from the radially-extending surface 110 and a central protrusion 116 axially protruding in the first axis A1 from the radially-extending surface 110. Each of the arcuate protrusions 114 has inner and outer arcuate surfaces 114*a* and 114*b* opposite to each other with respect to the first axis A1. The central protrusion 116 has an arcuate surface with respect to the second axis A2 to be coplanar with a sidewall of the opening 108*a*. The arcuate protrusions 114 and central protrusion 116 are configured to be riveted to the frame of the shielding shell of the electronic device. The outer flange 108 is formed with a cylindrical periphery having an axial center at the first axis A1, wherein the cylindrical periphery of the outer flange 108 vertically joins the radially-extending surfaces 110 and 112 and joins the axially-extending surface 111. The sleeve 10 has an annular step on an inner wall of the sleeve 10, wherein the annular step is formed with a first inner annular surface 121 with respect to an axial center at the first axis A1, a second inner annular surface 122 with respect to an axial center at the first axis A1 and a radially-extending surface 120 vertical to the first and second inner annular surfaces 121 and 122 and the first axis A1, wherein the radially-extending surface 120 joins the first and second inner annular surfaces 121 and 122 and the first inner annular surface 121 is formed with a greater diameter than the second inner annular surface 122 is formed. The tube 20 may be inserted into the sleeve 10 and surrounded by the first inner annular surface 121. The tube 20 has a front end abutting in an axial direction against the radially-extending surface 120 of the annular step of the sleeve 10.

Referring to FIGS. 1-4, the tube 20 may an insulating material, such as polymer, plastic material or rubber, including multiple bumps 202 outwardly protruding from an outer cylindrical periphery thereof. When the tube 20 is inserted into the sleeve 10, the sleeve 10 has the first inner annular surface 121 pressing the bumps 202 of the tube 20 such that the tube 20 may be fixed to the first inner annular surface 121 of the tube 20. A through hole 20*a* having an axial center at the first axis A1 passes through in the tube 20. An annular step on a sidewall of the through hole 20*a* is formed with a first inner annular surface 203 with respect to an axial center at the first axis A1, a second inner annular surface 204 with respect to an axial center at the first axis A1 and a radially-extending surface 206 vertical to the first and second inner annular surfaces 203 and 204 and the first axis A1, wherein the radially-extending surface 206 joins the first and second inner annular surfaces 203 and 204 and the first inner annular surface 203 is formed with a smaller diameter than the second inner annular surface 204 is formed.

Referring to FIGS. 1-4, the first fixing element 30 may be formed of an insulating material, such as polymer, plastic material or rubber, including multiple outer flexible elements 301 configured to be flexibly moved in a radial direction with respect to the first axis A1. When the first fixing element 30 is being assembled with the tube 20, the first fixing element 30 may be inserted from a front end of the tube 20 into the through hole 20*a* in the tube 20, in which the tube 20 is provided with multiple protrusions 205 inwardly protruding in radial directions vertical to the first axis A1 from the second inner annular surface 204 of the tube 20 to press the outer flexible elements 301 of the first fixing element 30 to be contracted. When the first fixing element 30 is well assembled with the tube 20, the outer flexible elements 301 of the first fixing element 30 are expanded such that the protrusions 205 of the tube 20 may abut in an axial direction against the outer flexible elements 301 of the first fixing element 30 to limit the first fixing element 30 from moving forward in an axial direction relative to the tube 20. The first fixing element 30 may include an annular step on an outer cylindrical periphery of the first fixing element 30, wherein the annular step of the fixing element 30 is formed with a first outer annular surface 302 with respect to an axial center at the first axis A1, a second outer annular surface 304 with respect to an axial center at the first axis A1 and a radially-extending surface 304*a* vertical to the first axis A1, wherein the radially-extending surface 304*a* joins the first and second outer annular surfaces 302 and 304 and the first outer annular surface 302 is formed with a smaller diameter than the second outer annular surface 304 is formed. The radially-extending surface 304*a* of the first fixing element 30 may abut in an axial direction against the radially-extending surface 206 of the tube 20, the first inner annular surface 203 of the tube 20 is sleeved onto the first outer annular surface 302 of the first fixing element 30 and the second inner annular surface 204 of the tube 20 is sleeved over the second outer annular surface 304 of the first fixing element 30.

Referring to FIGS. 1-4, the second fixing element 40 having a tubular shape may be formed of a conductive material, such as metal, copper, aluminum, silver, nickel, zinc, iron or an alloy of the above-mentioned materials, configured to be inserted into a through hole 30*a* passing through the first fixing element 30 and having an axial center at the first axis A1. The first fixing element 30 may have an inner annular flange 306 inwardly protruding in radial directions vertical to the first axis A1 from a sidewall of the through hole 30*a* in the first fixing element 30. The inner annular flange 306 is configured to abut in an axial direction against a rear end of the second fixing element 40. A through hole 40*a* passes through the second fixing element 40 and has an axial center at the first axis A1. The second fixing element 40 has two flexible metal sheets 402 bent inwardly from a cylindrical wall of the second fixing element 40 and positioned opposite to each other with respect to the first axis A1. Each of the flexible metal sheets 402 has a fixed end coupling the cylindrical wall of the second fixing element 40 and a free end configured to contact a metal core of a coaxial cable. An opening 403 at a rear end of the through hole 40*a* in the second fixing element 40 has an axial center at the first axis A1, and an opening 404 at a front end of the through hole 40*a* in the second fixing element 40 has an axial center at the first axis A1. The opening 403 has a greater diameter than that of the opening 404.

Referring to FIGS. 1-4, the third fixing element 50 may be formed of an insulating material, such as polymer, plastic material or rubber, including a first annular portion 502 having a cylindrical periphery with an axial center at the first axis A1 and a second annular portion 504 having a cylindrical periphery with an axial center at the second axis A2, wherein the first annular portion 502 has a greater diameter than that of the second annular portion 504. The second annular portion 504 integrally joins the first annular portion 502 into a single piece. A through hole 50*a* having an axial center at the second axis A2 is formed in the third fixing element 50. A cavity 505 communicating with the through hole 50*a* is formed in the third fixing element 5 to receive a rear end of the second fixing element 40, wherein the cavity 505 has a greater diameter than that of the through hole 50*a*. The second annular portion 504 may be inserted into the opening 108*a* at the front end of the sleeve 10 to protrude from the radially-extending surface 110 of the sleeve 10.

Referring to FIGS. 1-4, the metal trace 60 may be formed of a conductive material, such as metal, copper, aluminum, silver, nickel, zinc, iron or an alloy of the above-mentioned materials. The metal trace 60 is provided with a first axial-extension portion 602, which has an axial center at the first axis A1, configured to be inserted into the opening 404 in the second fixing element 40, a second axial-extension portion 604, which has an axial center at the second axis A2, configured to be inserted into the through hole 50*a* in the third fixing element 50 and a radial-extension portion 606 connecting the first axial-extension portion 602 to the second axial-extension portion 604. The radial-extension portion 606 of the metal trace 60 may be received in the cavity 505 in the third fixing element 50. After the second axial-extension portion 604 is inserted into the metal trace 60 is inserted into the through hole 50*a*, the metal trace 60 may have a protruding portion protruding from a front surface of the second annular portion 504 to be bent to form an electrical contact 610 configured to contact a pad of a circuit board and a bent portion 608 connecting the electrical contact 610 to the second axial-extension portion 604.

Referring to FIGS. 1-4, the third fixing element 50 may be considered as a first insulating element having a portion, i.e., a rear portion of the second annular portion 504, received in the opening 108*a*. The through hole 50*a* in the first insulating element 50 having an axial center at the second axis 50*a* receives the second axial-extension portion 604 of the metal trace 60. The cavity 505 in the first insulating element 50 having a greater diameter than that of the through hole 50*a* in the first insulating element 50 receives the radial-extension portion 606 of the metal trace 60 and a front portion of the first axial-extension portion 60 of the metal trace 60. The second fixing element 40 may be a metal element assembled in the sleeve 104. The opening 404 in the metal element 40 having an axial center at the first axis A1 may be sleeved onto a rear portion of the first axial-extension portion 602 of the metal trace 60. The opening 403 in the metal element 40 has a greater diameter than that of the opening 404 in the metal element 40. The opening 403 having an axial center at the first axis A1 communicates with the opening 404. The metal element 40 may include the flexible metal sheets 402 coupling the cylindrical wall of the metal element 40 and bent inwardly from the cylindrical wall of the second fixing element 40 to the through hole 40*a* in the metal element 40. The first fixing element 30 may be a second insulating element assembled in the sleeve 104 and sleeved onto the metal element 40. The through hole 30*a* in the second insulating element 30 having an axial center at the first axis A1 receives a rear portion of the metal element 40. The second insulating element 30 has the inner annular flange 306 inwardly protruding, in radial directions vertical to the first axis A1, to the through hole 30*a* in the second insulating element 30 and abutting in an axial direction against the metal element 40. The tube 20 is assembled in the sleeve 10 and sleeved onto the second insulating element 30. The through hole 20*a* in the tube 20 has an axial center at the first axis A1 and receives the second insulating element 30. The tube 20 has an inner annular flange, provided with the radially-extending surface 206, inwardly protruding, in radial directions vertical to the first axis A1, to the through hole 20*a* in the tube 20. The second insulating element 30 has an outer annular flange, provided with the radially-extending surface 304*a*, outwardly protruding, in radial directions vertical to the first axis A1, from a cylindrical wall of the second insulating element 30 and abutting in an axial direction against the inner annular flange of tube 20.

Referring to FIGS. 5A to 5B, the connector 100 may be mounted onto a frame 70 of a shielding shell of an electronic device, wherein the shielding shell may be configured for shielding interference of electromagnetic waves. The electronic device may include a main board assembled in a space surrounded by the frame 70 of the shielding shell. Multiple openings 74 in a sideboard 72 of the frame 70 may have shapes and sizes corresponding to those of the arcuate protrusions 114 and central protrusion 116. The arcuate protrusions 114 and central protrusion 116 and the second annular portion 504 of the first insulating element 50 may be inserted into the corresponding openings 74 and then the arcuate protrusions 114 may be riveted onto the sideboard 72, in which a punch may be applied onto the arcuate protrusions 114 to be deformed each with an enlarged portion having a width in a dimension greater than a width in the dimension of the corresponding opening 74 to prevent the arcuate protrusions 114 from being dropped off from the corresponding openings 74.

Referring to FIG. 5C, after the connector 100 is mounted onto the sideboard 72 of the frame 70, a connector 90 for a coaxial cable 80 may be screwed onto the connector 100. The connector 90 for the coaxial cable 80 may be a screw-on F-type connector. The connector 90 for the coaxial cable 80 may include a nut 92 having an inner thread configured to be screwed onto the outer thread 102 of the sleeve 10 such that the nut 92 electrically coupled to the sleeve 10 may be electrically connected to an electrical ground. The coaxial cable 80 may include a metal core 82 configured to be inserted into the through holes 30*a* and 40*a* and to contact the flexible metal sheets 402. Thereby, the flexible metal sheets 402 may clip the metal core 82. The metal element 40 may connect the metal core 82 to the metal trace 60. However, the nut 92 should stop being screwed on the sleeve 10 when the connector 90 for the coaxial cable 80 has an inner sleeve 94 abutting against the rear end of the sleeve 10. In fact, the nut 92 cannot immediately stop. At this time, the bonding of the arcuate protrusions 114 to the frame 70 may prevent the connector 100 from being dropped off from the sideboard 72. Further, the second annular portion 504 inserted into one of the openings 74 in the sideboard 72 has an axial center at the second axis A2 offset from an coaxial center of the nut 92 of the connector 90 at the first axis A1, and thereby the offset bonding of the second annular portion 504 to one of the openings 74 in the sideboard 72 may further resist a torque of the nut 92 being screwed onto the sleeve 10. Accordingly, the bonding of the connector 100 to the sideboard 72 of the frame 70 maybe strengthened.

The components, steps, features, benefits and advantages that have been discussed are merely illustrative. None of them, nor the discussions relating to them, are intended to limit the scope of protection in any way. Numerous other embodiments are also contemplated. These include embodiments that have fewer, additional, and/or different components, steps, features, benefits and advantages. These also include embodiments in which the components and/or steps are arranged and/or ordered differently.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain. Furthermore, unless stated otherwise, the numerical ranges provided are intended to be inclusive of the stated lower and upper values. Moreover, unless stated otherwise, all material selections and numerical values are representative of preferred embodiments and other ranges and/or materials may be used.

The scope of protection is limited solely by the claims, and such scope is intended and should be interpreted to be as broad as is consistent with the ordinary meaning of the language that is used in the claims when interpreted in light of this specification and the prosecution history that follows, and to encompass all structural and functional equivalents thereof.

What is claimed is:

1. A connector configured to be screwed with another connector for a coaxial cable, comprising:

a sleeve having an outer thread configured to be screwed with an inner thread of a nut of said another connector, wherein a first opening in said sleeve has an axial center at a first axis and a second opening in said sleeve has an axial center at a second axis, wherein said first and second axes are parallel to and offset from each other, and wherein said sleeve has a radially-extending surface substantially vertical to said second axis, wherein said sleeve comprises a first protrusion axially protruding in said second axis from said radially-extending surface, wherein said first protrusion has an arcuate surface with respect to said second axis to be substantially coplanar with a sidewall of said second opening in said sleeve.

2. The connector of claim 1, wherein said first protrusion comprises an arcuate protrusion axially protruding in said second axis from said radially-extending surface, wherein said arcuate protrusion has an inner arcuate surface extending with respect to said first axis and an outer arcuate surface extending with respect to said first axis, wherein said inner and outer arcuate surfaces are opposite to each other.

3. The connector of claim 1, wherein said sleeve comprises a second protrusion axially protruding in said second axis from said radially-extending surface.

4. The connector of claim 1, wherein said first and second protrusions are configured to be riveted to a board.

5. The connector of claim 1, wherein said sleeve has a first radially-extending surface vertical to said first axis, a second radially-extending surface vertical to said first axis and an axially-extending surface substantially vertically joining said first and second radially-extending surfaces, wherein said first and second radially-extending surfaces and axially-extending surface form a step, wherein said sleeve has a cylindrical periphery substantially vertical to said first and second radially-extending surfaces, wherein said axially-extending surface has two opposite sides joining said cylindrical periphery.

6. The connector of claim 1, wherein said first opening in said sleeve has a greater diameter than that of said second opening in said sleeve.

7. The connector of claim 1 further comprising a metal trace provided with a first extension portion having an axial center at said first axis and a second extension portion having an axial center at said second axis, wherein said first extension portion is connected to said second extension portion.

8. The connector of claim 1 further comprising a first insulating element having a portion received in said second opening in said sleeve, wherein a through hole in said first insulating element has an axial center at said second axis and accommodates said second extension portion of said metal trace.

9. The connector of claim 1, wherein a cavity in said first insulating element has a greater diameter that that of said through hole in said first insulating element, wherein said cavity in said first insulating element accommodates an end of said first extension portion of said metal trace.

10. The connector of claim 1 further comprising a metal element in said sleeve, wherein said metal element is sleeved onto said first extension portion of said metal trace, wherein a first opening in said metal element has an axial center at said first axis and accommodates an end of said first extension portion of said metal trace.

11. The connector of claim 10, wherein a second opening in said metal element has a greater diameter than that of said first opening in said metal element and has an axial center at said first axis, wherein said first and second openings in said metal element communicate with each other, wherein said metal element comprises multiple metal sheets joining a cylindrical wall of said metal element, wherein said metal sheets are inwardly bent from said cylindrical wall of said metal element.

12. The connector of claim 10 further comprising a second insulating element in said sleeve, wherein said second insulating element is sleeved onto said metal element, wherein a through hole in said second insulating element has an axial center at said first axis and accommodates an end of said metal element, wherein said second insulating element has an inner flange radially protruding, in radial directions vertical to said first axis, from an inner cylindrical surface of said second insulating element to said through hole in said second insulating element and axially abutting against said metal element.

13. The connector of claim 12 further comprising a tube in said sleeve, wherein said tube is sleeved onto said second insulating element, wherein a through hole in said tube has an axial center at said first axis and accommodates an end of said second insulating element, wherein said tube has an inner flange radially protruding, in radial directions vertical to said first axis, from an inner cylindrical surface of said tube to said through hole in said tube, wherein said second insulating element has an outer flange radially protruding, in radial directions vertical to said first axis, from an outer cylindrical surface of said second insulating element and axially abutting against said inner flange of said tube.

14. A connector configured to be screwed with another connector for a coaxial cable, comprising:

a sleeve having an outer thread configured to be screwed with an inner thread of a nut of said another connector, wherein a first opening in said sleeve has an axial center at a first axis and configured to receive a front portion of a metal core of said coaxial cable, wherein said sleeve comprises multiple protrusions axially protruding in said second axis from said radially-extending surface, wherein said protrusions are configured to be riveted to a board; and an first insulating element having an annular portion received in a second opening in said sleeve, wherein said annular portion has a cylindrical periphery with respect with a second axis, wherein said first and second axes are parallel to and offset from each other.

15. The connector of claim 14, wherein a through hole in said first insulating element has an axial center at said second axis.

16. The connector of claim 15 further comprising a metal trace provided with a first extension portion having an axial center at said first axis and a second extension portion having an axial center at said second axis, wherein said second extension portion is received in said through hole in said first insulating element, wherein said first extension portion is connected to said second extension portion.

17. The connector of claim 16, wherein a cavity in said first insulating element has a greater diameter that that of said through hole in said first insulating element, wherein said cavity in said first insulating element accommodates an end of said first extension portion of said metal trace.

18. The connector of claim 14, further comprising a metal element in said sleeve, wherein said metal element is sleeved onto said first extension portion of said metal trace, wherein a first opening in said metal element has an axial center at said first axis and accommodates an end of said first extension portion of said metal trace.

19. The connector of claim 18, wherein a second opening in said metal element has a greater diameter than that of said first opening in said metal element and has an axial center at said first axis, wherein said first and second openings in said metal element communicate with each other, wherein said metal element comprises multiple metal sheets joining a cylindrical wall of said metal element, wherein said metal sheets are inwardly bent from said cylindrical wall of said metal element.

20. The connector of claim 18 further comprising a second insulating element in said sleeve, wherein said second insulating element is sleeved onto said metal element, wherein a through hole in said second insulating element has an axial center at said first axis and accommodates an end of said metal element, wherein said second insulating element has an inner flange radially protruding, in radial directions vertical to said first axis, from an inner cylindrical surface of said second insulating element to said through hole in said second insulating element and axially abutting against said metal element.

* * * * *